US007950159B2

(12) United States Patent
Popendorf

(10) Patent No.: US 7,950,159 B2
(45) Date of Patent: May 31, 2011

(54) SUNDIAL

(76) Inventor: Joyce Popendorf, North Logan, UT (US)

( * ) Notice: Subject to any disclaimer, the term of this patent is extended or adjusted under 35 U.S.C. 154(b) by 187 days.

(21) Appl. No.: 12/409,271

(22) Filed: Mar. 23, 2009

(65) Prior Publication Data

US 2010/0236083 A1 Sep. 23, 2010

(51) Int. Cl.
*G04B 49/02* (2006.01)

(52) U.S. Cl. ..... 33/270

(58) Field of Classification Search ..... 33/268–271
See application file for complete search history.

(56) References Cited

U.S. PATENT DOCUMENTS

| | | | | |
|---|---|---|---|---|
| 1,674,161 | A * | 6/1928 | De Bogory | 33/270 |
| 2,207,195 | A * | 7/1940 | Guadet | 33/270 |
| 3,099,881 | A * | 8/1963 | Snider et al. | 33/270 |
| 3,486,234 | A * | 12/1969 | Waterman | 33/270 |
| 3,815,249 | A * | 6/1974 | Gundlach | 33/269 |
| 4,317,031 | A | 2/1982 | Findell | |
| 4,338,727 | A * | 7/1982 | Gundlach | 33/269 |
| 4,520,572 | A | 6/1985 | Spilhaus | |
| 4,922,619 | A | 5/1990 | Singleton | |
| 5,197,199 | A | 3/1993 | Shrader | |
| 6,301,793 | B1 | 10/2001 | Gottesman et al. | |

FOREIGN PATENT DOCUMENTS

| | | | |
|---|---|---|---|
| CH | 667969 | A * | 11/1988 |
| DE | 3429750 | A * | 2/1986 |
| FR | 2634568 | A1 * | 1/1990 |
| FR | 2645290 | A1 * | 10/1990 |
| GB | 1445146 | A * | 8/1976 |
| GB | 2158618 | A * | 11/1985 |
| JP | 62151782 | A * | 7/1987 |
| JP | 2003066166 | A * | 3/2003 |
| NL | 1006332 | C2 * | 11/1998 |
| SE | 469807 | B * | 9/1993 |
| WO | WO 9316420 | A1 | 8/1993 |
| WO | WO 9725655 | A1 | 7/1997 |

OTHER PUBLICATIONS

Fredrick W. Sawyer, III, "Of Analemmas, Mean Time and the Analemmatic Sundial" Bulletin of the British Sundial Society, Jun. 1994, 94(2): 2-6.

(Continued)

*Primary Examiner* — R. A. Smith
(74) *Attorney, Agent, or Firm* — Matthew D. Thayne; Stoel Rives LLP

(57) ABSTRACT

Disclosed are embodiments of a sundial. Various embodiments of the sundial disclosed herein may be used to determine the time of day based on the position of the sun. The sundial may utilize a curved reflector to reflect the image of the sun onto a dial-face. The curved reflector may be disposed, at least in part, behind the dial-face. A portion of the curved reflector behind the dial-face may be used to reflect an image of the sun onto a back surface of the dial-face. The reflected image of the sun received on the back of the dial-face may, in some embodiments, be visible on the front surface of the dial-face. The dial-face may have a plurality of time markings positioned thereon. The position of the image of the sun on the dial-face may be compared to the plurality of time markings to determine at least an approximation of the time of day.

29 Claims, 7 Drawing Sheets

OTHER PUBLICATIONS

*Image: Caustic of a circle* 2.svg., http://en.wikipedia.org/wiki/Image:Caustic_of_a_circle_2.svg, Nov. 18, 2008.
*Spherical aberration* , http://en.wikipedia.org/wiki/Spherical_aberration Nov. 18, 2008.
*Equation of Time*, http://en.wikipedia.org/wiki/Equation_of_time Nov. 18, 2008.
*Image: Analemma Earth.png*, http://en.wikipedia.org/wiki/Image:Analemma_Earth.png Dec. 1, 2008.
*Sundial Patents*, Brooke Clark, 2002-2007, http.//www.prc68 com/l/SD_Pat2.shtml Oct. 30, 2008.
*Sundials from Helios: press opinions*, www.helios-sundials.com/Sundial-Press-Opinions.html Oct. 30, 2008.
Sundials, www.absoluteastronormy.com/topics/Sundial, Oct. 30, 2008.
*Photos & Multimedia*, http://seattlepi.nwsource.com/photos/photo.asp?PhotolD=33110, Oct. 30, 2008.
Google Search for "patent search sundials", Oct. 30, 2008, http://google.com/search?hl=en&client=firefox-a&channel=s&.
*Reflecting Sundials*, www.helios-sundials.com, Oct. 30, 2008.
*Precision Sundials LLC, Renaissance Focusing Sundial*, http://www.precisionsundials.com/renaissance.htm, Oct. 30, 2008.
*Precision Sundials LLC, Sundials with Latitude*, http://www.precisionsundials.com/, Oct. 30, 2008.
*Theclockworks, My Sundial*, Roger Bruce, http://theclockworks.me.uk/id17.html Oct. 30, 2008.
*Analemmic-Equatorial Sundials*, Pete Swanstrom, http://www.swanstrom.net/sundial/index2.htm, Oct. 30, 2008.
*Stretched Lens Array* (*SLA*), Entech A WorldWater & Solar Tehcnologies Company, http://www.worldwater.com/Entech-2008/pages/stretched_lens_array . . . , Oct. 30, 2008.
*Aero-News.Net, Top News*, http://aero-news.net/index.cfm?ContentBlockID=9ec29ad-4d..., Oct. 10, 2008.
*PV Watts: AC Energy & Cost Savings*, http://rredc.nrel.govisolar/codes_algs/PV WATTS/version1/Lis/code, date unknown.
*Rikers Island PV Roofing System, Photovoltaics in the Built Environment*, p. 47, date unknown.
*Georgia Institute of Technology Aquatic Center Entry Pavilion, Photovoltaics in the Built Environment*, p. 46, date unknown.
*Improving Space Utilization by Increasing Solar Array Reliability*, Henry W. Brandhorst, Jr., et al.
*Multi-tower Line Focus Fresnel Array Project*, Mills, et al., *Journal of Solar Energy Engineering, J. Sol. Energy Eng*., vol. 128, Issue 1, Technical Briefs, 2006, http://scitation.aip.org/getabs/servlet/GetabsServlet?prog=normal&id=JSEEDO000128000001000118000001&idtype=cvips&gifs=Yes&ref=no, Oct. 30, 2008.
*Spherical Mirros*, J.B. Calvert, http://mysite.du.edu/~-jcalvert/optics/mirror.htm , Aug. 2003.
Year 2004, *Work of Our Members, A CD-Sundial*, http://www.dezonnewijzerkring.nl/werk-arch/eng-home-werk-04-06.htm, Oct. 30, 2008.

* cited by examiner

SUNDIAL

TECHNICAL FIELD

The present disclosure relates to a sundial and, in some embodiments, to a sundial that uses a curved reflector to create a reflected image of the sun on a dial-face to indicate the time of day.

BRIEF DESCRIPTION OF THE DRAWINGS

Understanding that drawings depict only certain preferred embodiments and are not therefore to be considered to be limiting in nature, the preferred embodiments will be described and explained with additional specificity and detail through the use of the accompanying drawings in which.

DETAILED DESCRIPTION OF PREFERRED EMBODIMENTS

Figure 1:
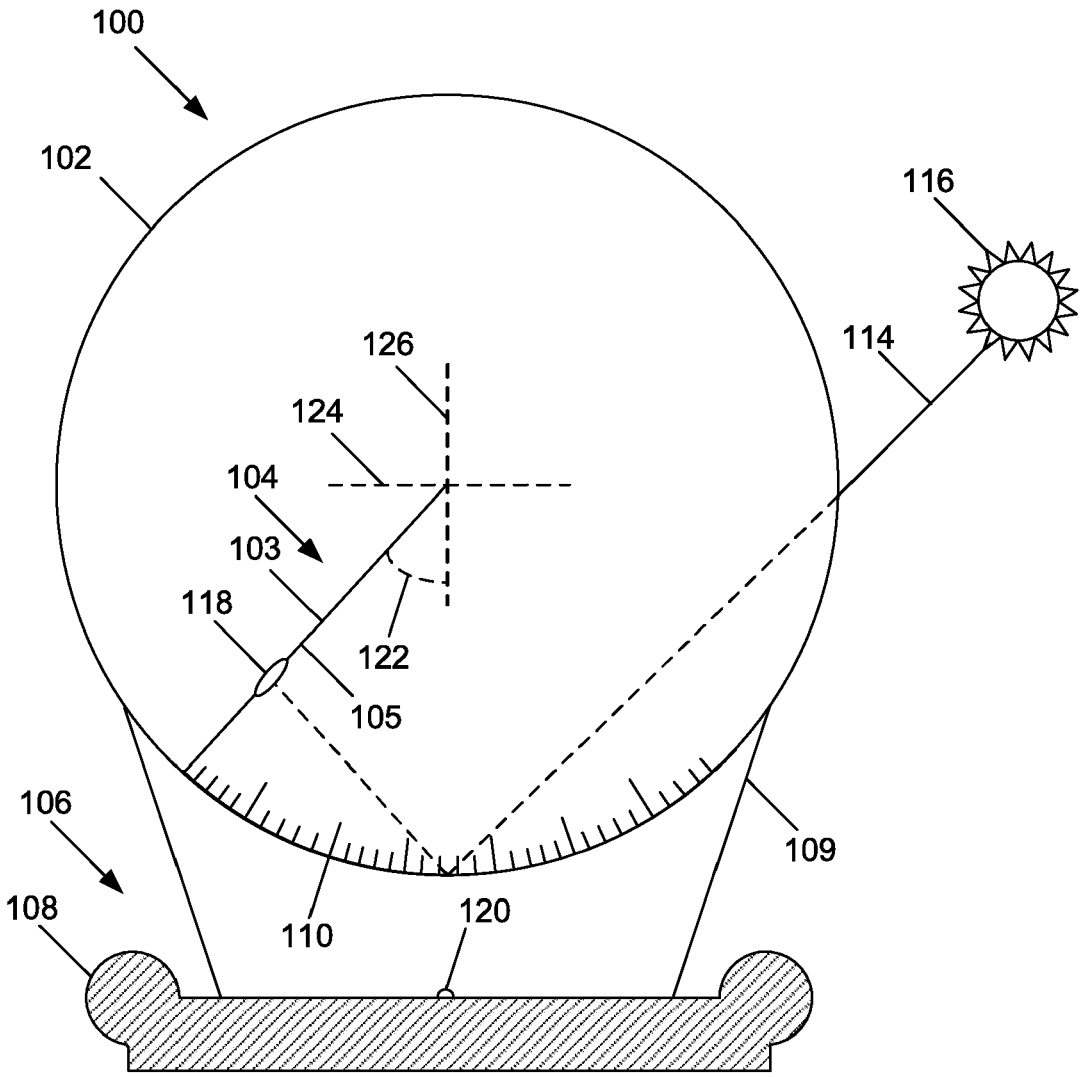
FIG. 1 is a cross-sectional view of one embodiment of a sundial according to the present disclosure.

In the following description, numerous specific details are provided for a thorough understanding of specific preferred embodiments. However, those skilled in the art will recognize that the invention can be practiced without one or more of the specific details, or with other methods, components, materials, etc.

In some cases, well-known structures, materials, or operations are not shown or described in detail in order to avoid obscuring aspects of the preferred embodiments. Furthermore, the described features, structures, or characteristics may be combined in any suitable manner in one or more embodiments.

Disclosed are embodiments of a sundial. Various embodiments of the sundial disclosed herein may be used to determine the time of day based on the position of the sun. The sundial may utilize a curved reflector to reflect the image of the sun onto a dial-face. The curved reflector may be disposed, at least in part, behind (relative to a viewer of the sundial) the dial-face. A portion of the curved reflector may be used to reflect an image of the sun onto the back of the dial-face. Depending upon the material(s) used for the dial-face, the reflected image of the sun received on the back of the dial-face may be visible on the front of the dial-face (and/or the back of the dial-face). In some embodiments, the dial-face may be made up of one or more translucent materials, such as copper mesh, aerogel, silica gel, acrylic, glass, cloth, and/or other suitable materials. The dial-face may also have a plurality of time markings on one or both of its opposing surfaces. The position of the image of the sun on the front of the dial-face may, in some embodiments, be compared to the plurality of time markings to determine the time of day. The reflected image of the sun may exhibit optical aberration caused by the curved reflector and/or by the impact of seasonal variations in the Earth's orbit. In certain embodiments, the optical aberration may elongate the reflected image of the sun such that the reflected image may take the general appearance of a clock hand or the like.

In one embodiment, the curved reflector may comprise a transparent and partially-reflective sphere. The dial-face may be positioned within the sphere. In certain embodiments, the sphere may comprise acrylic or glass. In other embodiments, a latitude marker may be placed on the sphere, and may allow the sundial to be adjusted to operate at a given latitude by rotating the sphere, thereby reorienting the angle of the dial-face with respect to the angle of incidence of sunlight. In embodiments not comprising a sphere, the dial-face may be reoriented in other ways, as those of ordinary skill in the art will appreciate. The latitude markings may be positioned along the sphere and may be aligned with a reference line at an appropriate marking corresponding to the user's latitude on Earth.

In some embodiments, a stand may be provided for the reflector or sphere. The stand may be a ring having a radius smaller than the radius of the sphere. Accordingly, the stand may hold the sphere with no fixed points of connection between the stand and the sphere, and may thus allow the sphere to be rotated with respect to the stand.

In certain embodiments, the sundial may include a directional indicator. When used in the Northern hemisphere, the directional indicator may be used to orient the sundial such that front side of the dial-face is oriented due north, while the back side of the dial-face is oriented toward the sun (or south). When used in the Southern hemisphere, the directional indicator may be used to orient the sundial such that the front side of the dial-face is oriented due south, while the back side of the dial-face is oriented toward the sun (or north).

In some embodiments, the directional indicator may include a line placed on the stand. To orient the sundial in such embodiments, the user would orient the directional line in a north-south direction. The latitude marker may then be oriented parallel to the directional line. A line perpendicular to the directional line may also be included to provide a reference for aligning the latitude markings with a user's particular latitude on Earth.

In certain embodiments, the sundial may be self-orienting. In one embodiment, one or more components of the sundial may be positioned within a reservoir of liquid. For example, in one embodiment, the curved reflector may float in a reservoir of water. An appropriately aligned bar magnet may be attached to the curved reflector. The magnet may, if increased accuracy is needed, be aligned with respect to the curved reflector so as to compensate for any disparity between true north and magnetic north at a particular location on Earth. In certain embodiments, a radial gauge may be used to align the magnet with respect to the curved reflector. Markings on the radial gauge may be used to offset the alignment of the magnet with respect to the curved reflector by an amount equal to the magnetic declination at the user's location.

More specific embodiments will now be described in greater detail with reference to the accompanying drawings. The following more detailed description of various embodiments, as represented in the accompanying drawings, is not intended to limit the scope of the present disclosure, but is merely representative of various embodiments. While various aspects of certain embodiments are presented in the drawings, the drawings are not necessarily drawn to scale. Reference numbers in the drawings are each greater than 100. Numbers in the drawings less than 100 illustrate features of various embodiments, including time markings using the numbers 5 through 12 (see FIGS. 2, 4A and 4B), latitude markers using the numbers 0 through 90 (see FIGS. 3, 7B, and 7C), and angle markers using the numbers 0 through 45 (FIGS. 7A, 7B, and 7C.

FIG. 1 is a cross-sectional view of an embodiment of a sundial 100 including a stand 106 and a curved reflector 102. Stand 106 includes a base 108 and a support piece 109. In some embodiments, base 108 may be a separate component from support piece 109. Alternatively, base 108 may be integrally formed with support piece 109. The sun 116 casts a ray of light 114 onto curved reflector 102. Ray 114 is reflected by curved reflector 102 onto a back surface 105 of a dial-face 104, creating a reflected image 118 of the sun.

Figure 4A:
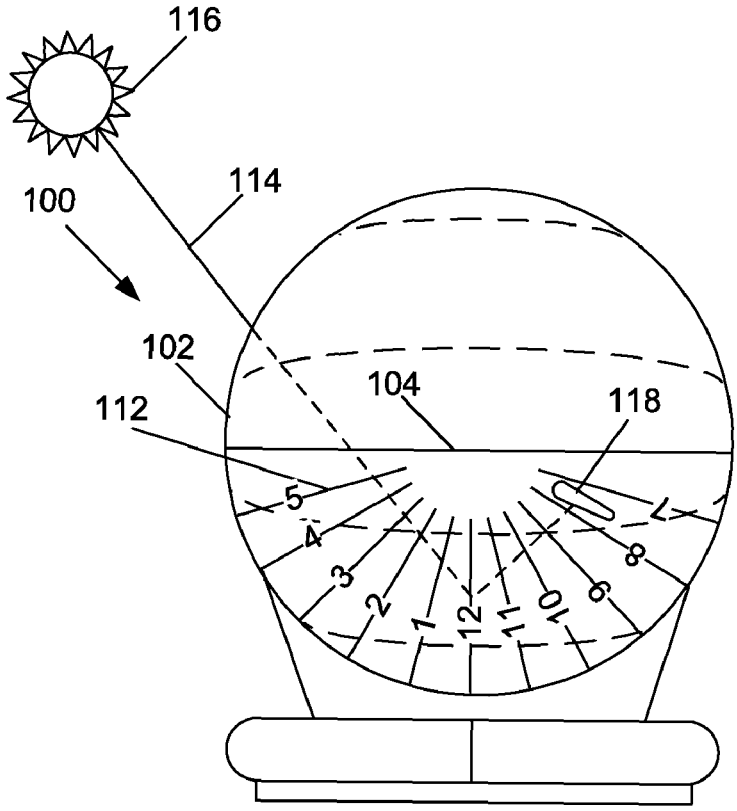
FIG. 4A and FIG. 4B are front elevation views of one embodiment of a sundial showing the location of a reflected image of the sun at two different times of day.
Figure 4B:
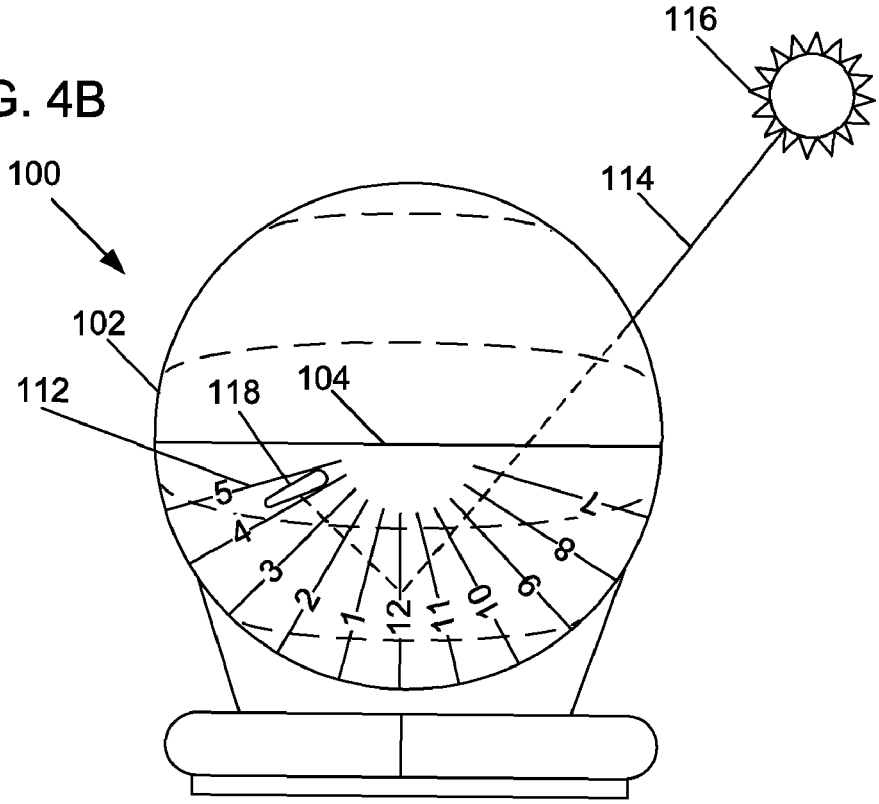

As better illustrated in FIGS. 4A and 4B, the position of reflected image 118 with respect to a plurality of time markers (reference no. 112 in FIGS. 4A and 4B) disposed on the front surface 103 of dial-face 104 indicates the time of day. As illustrated, reflected image 118 is reflected onto the back surface 105 of dial-face 104. In embodiments where the face is at least partially transparent, the reflected image 118 may be viewed on the two opposing surfaces 103, 105 of dial face 104. In the depicted embodiment, dial-face 104 comprises a flat material in the shape of a semicircle that fits within half of a circumference of the reflector 102. However, a variety of other embodiments are contemplated with dial-faces having other shapes. In some embodiments, dial-face 104 may comprise a material that would permit the reflected image 118, which is reflected onto the back surface of dial-face 104, to be visible on the front surface 103 of dial-face 104. In one embodiment, dial-face 104 comprises a copper mesh. In another embodiment, dial-face 104 comprises aerogel. In yet other embodiments, dial-face 104 may comprise a plastic mesh, cloth, glass, or acrylic.

In FIG. 1, curved reflector 102 is a sphere. It is contemplated that in alternative embodiments curved reflector 102 may be embodied as a portion of a sphere (e.g. a half sphere or a quarter sphere), a cylinder, or other curved geometry. The curved reflector 102 may be only partially reflective, and may also be partially transparent. In one embodiment, curved reflector 102 may be acrylic or glass. In such embodiments, curved reflector 102 may completely surround and hold dial-face 104. In alternative embodiments, curved reflector 102 may have portions lined with a highly reflective material, so as to maximize the brightness of reflected image 118, and to facilitate the reading of sun dial 100.

Latitude marker 110 may be disposed on sphere 102 and may allow sundial 100 to be adjusted for use at a given latitude (e.g., the latitude of the location at which sundial 100 is to be used). A line 120 may be positioned directly below the center of curved reflector 102. Line 120 may be connected to a base 108. In some embodiments, line 120 may comprise a three-dimensional shape, such as a cylinder or rod. In other embodiments, line 120 may simply be two-dimensional, such as an acrylic transfer, a marking from a line or pen, or the like.

In one embodiment, sundial 100 may be adjusted to a given latitude by rotating curved reflector 102 until a line corresponding to a desired latitude of latitude marker 110 is positioned above line 120. For purposes of illustration, a vertical reference line 126 and a horizontal reference line 124 are shown in FIG. 1. Horizontal reference line 124 and vertical reference line 126 bisect curved reflector 102. An angle 122 is the angle between the dial-face and vertical reference line 126. When positioned for a given latitude, angle 122 of the dial-face 104 with respect to vertical reference line 126 is equal to the given latitude. For example, if the latitude of a location at which sundial 100 is to be used is 30°, curved reflector 102 may be rotated such that angle 122 is equal to 30°. In certain embodiments, curved reflector 102 is able to be rotated within stand 106, so as to allow for the adjustment of the latitude corresponding to the latitude of the location of the sundial 100. In alternative embodiments, dial-face 104 may be pivotally connected with curved reflector 102, and dial-face 104 may be pivoted such that angle 122 is equal to the user's latitude. In still further embodiments, latitude marker 110 may be positioned on stand 106.

Figure 2:
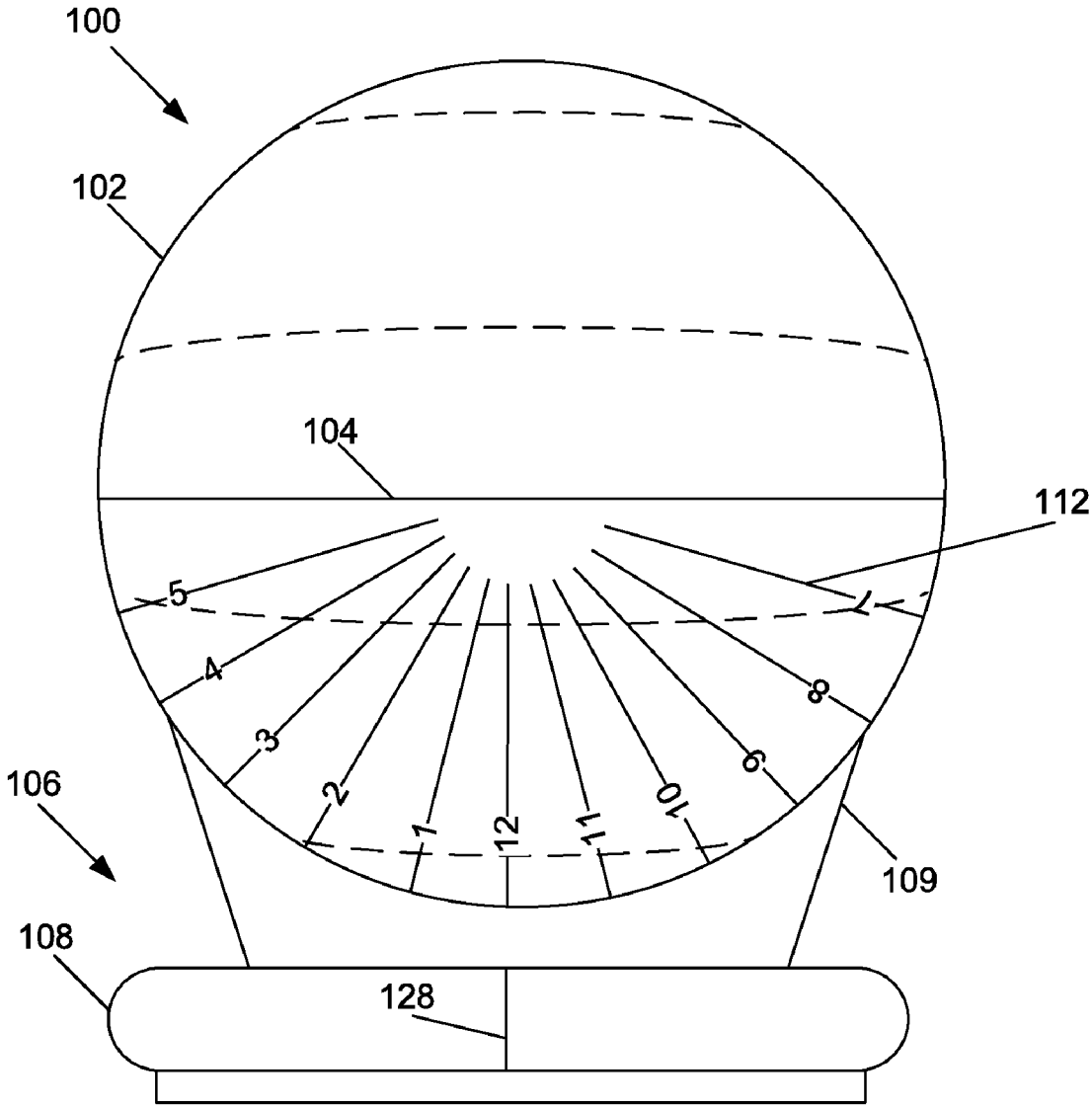
FIG. 2 is a front elevation view of one embodiment of a sundial according to the present disclosure.

FIG. 2 is a front elevation view of sundial 100. A plurality of time markings 112 are disposed on dial-face 104. In one embodiment, base 108 includes a directional indicator 128 which is to be oriented north in the Northern Hemisphere when sundial 100 is in operation. In the Southern Hemisphere, indicator 128 would be oriented south. In the embodiment illustrated in FIG. 2, time markings 112 are spaced 15° apart, corresponding to the 360 degrees of rotation of the Earth in one day divided by 24 hours. Other spacings of time markings 112 are contemplated and depend on the geometry of dial-face 104 and the physical size of the sundial. For example, additional time markings may be added as the physical scale of the sun dial increases. A large sundial 100 may include time markings that correspond to every 30 minutes of a day (or less), while a small sun dial 100 may only include time markings that correspond to every hour of a day.

Further adjustments or refinements could be employed to compensate for a user's longitude, variations in the Earth's orbit compensated for using the equation of time, and daylight savings time. In other embodiments, a user may adjust for the variance in degrees of longitude of the user's location from the center of the user's time zone. For example Salt Lake City, Utah is approximately 7° of longitude west of Denver, Colo., which is approximately at the center of the Mountain Time Zone. The solar time indicated on the dial-face 104 of sundial 100 will be approximately 28 minutes behind standard time in Salt Lake City, Utah, unless an appropriate adjustment is made. In order to adjust sundial 100 to operate in Salt Lake City, Utah, directional indicator 128 may be rotated to the West by 7°. In an alternate method for adjusting sun dial 100, a user may rotate face 104 such that directional indicator 128 aligns with the point on face 104 corresponding to 12:28 PM. Sun dial 100 may also be adjusted by rotating face 104 in order to compensate for seasonal variations in solar time caused by the obliquity of the Earth's rotational axis and the eccentricity of the Earth's orbit. For example, at the end of March, solar time is five minutes behind standard time. By rotating face 104 such that directional indicator 128 aligns with the point on face 104 corresponding to 12:05, the seasonal variation may be corrected. A table or chart listing adjustments between solar time and standard time at various times throughout the year may be included with sundial 100. A user may refer to the table or chart in order to periodically adjust sundial 100. Face 104 may also be rotated in a similar method to compensate for daylight savings time.

Figure 3:
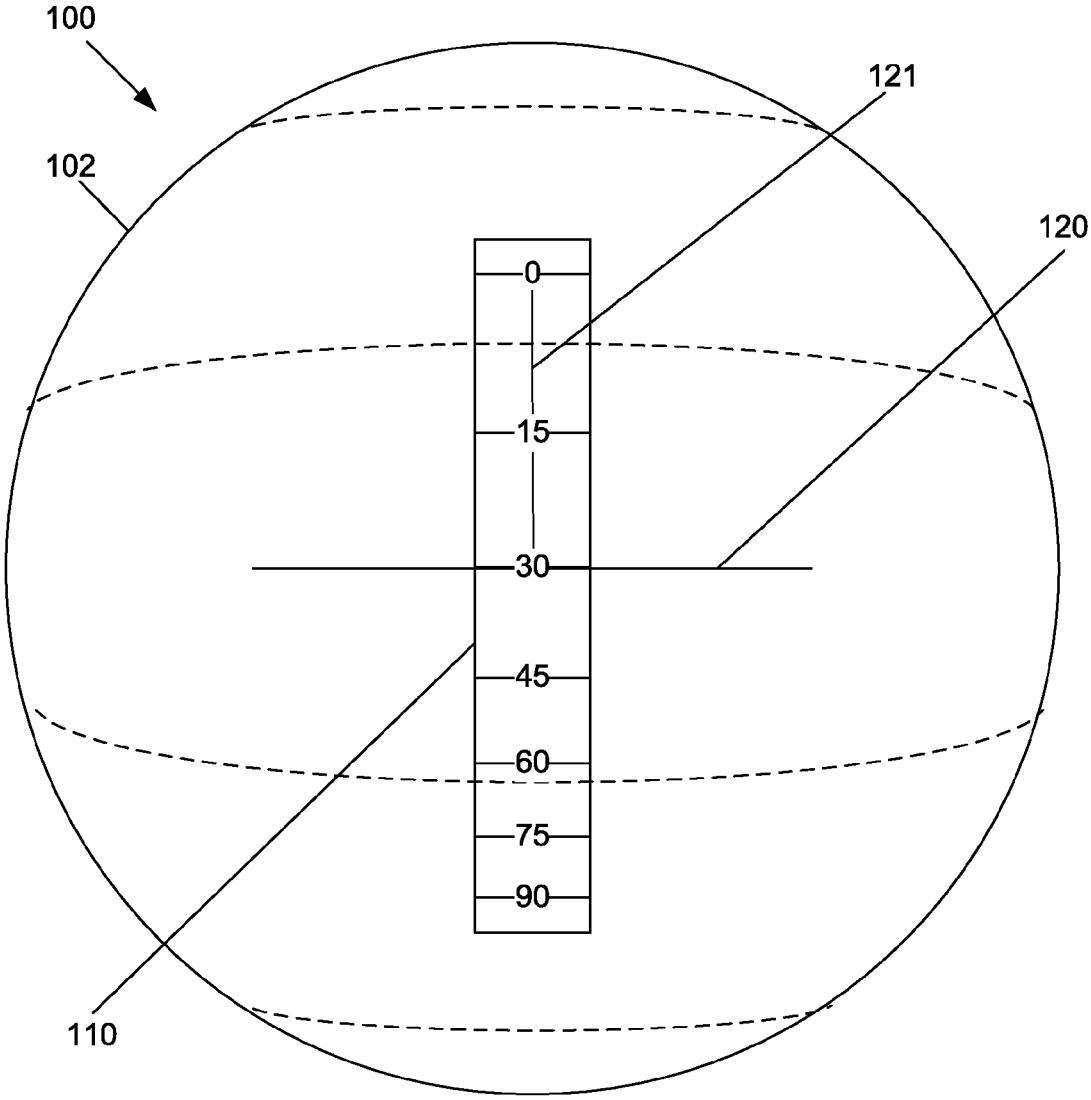
FIG. 3 is a plan view of one embodiment of a sundial according to the present disclosure.

FIG. 3 is a plan view of sundial 100. As discussed above, sundial 100 may be adjusted for a given latitude. In one embodiment, sundial 100 may be adjusted to a given latitude by rotating curved reflector 102 until a latitude marker 110 corresponding to a desired latitude is positioned above line 120. Line 120 may be positioned on a stand (as shown in FIG. 1), rather than the curved reflector 102, while latitude marker 110 may be positioned on curved reflector 102. Latitude marker 110 includes degree line markings in fifteen-degree increments. Of course, other increments are also contemplated.

Support piece 109 (shown in FIGS. 1 and 2) of stand 106 may be circular, and comprise a ring having a radius that is smaller than the radius of curved reflector 102. Curved reflector 102 may be placed on the support piece 109, and may hold curved reflector 102 with no fixed points of connection between stand 106 and curved reflector 102. Accordingly, curved reflector 102 may be rotated with respect to stand 106 to a desired latitude.

A directional line 121 (similar to reference no. 128 in FIG. 2) may be placed on curved reflector 102 instead of, or in addition to, directional indicator 128. To orient the sundial in such embodiments, directional line 121 would simply be oriented in a north-south direction. Latitude marker 110 may be generally oriented parallel to the directional line 121. Line 120 may be perpendicular to directional line 121.

FIGS. 4A and 4B illustrate sun 116 in two different positions, and illustrate the corresponding positions of reflected image 118. In FIG. 4A, ray 114 is reflected by curved reflector 102 and creates reflected image 118 on dial-face 104. Reflected image 118 is between time markers 112 corresponding to 7:00 AM and 8:00 AM, indicating that the time is approximately 7:30. In FIG. 4B, reflected image 118 is between time markers 112 corresponding to 4:00 PM and 5:00 PM, indicating that the time is approximately 4:30. As sun 116 moves across the sky during the course of the day, reflected image 118 moves uniformly across dial-face 104 to provide an at least approximate indication of the time of day.

Reflected image 118 may be elongated, as shown in FIGS. 4A and 4B, by optical aberration and/or the impact of seasonal variations in the Earth's orbit. In one embodiment, a spherical reflector is utilized, and thus reflected image 118 may exhibit spherical aberration. Spherical reflectors do not focus light to a point. Rather, spherical reflectors focus rays more tightly if they enter far from the optic axis than if they enter closer to the axis. The elongation of the reflected image 118 may be enhanced by the seasonal variation of the Earth's orbit around the sun, and the Earth's axial tilt of 23 degrees. In September and March, reflected image 118 may appear more elongated, while in June and December reflected image 118 may appear less elongated.

Figure 5A:
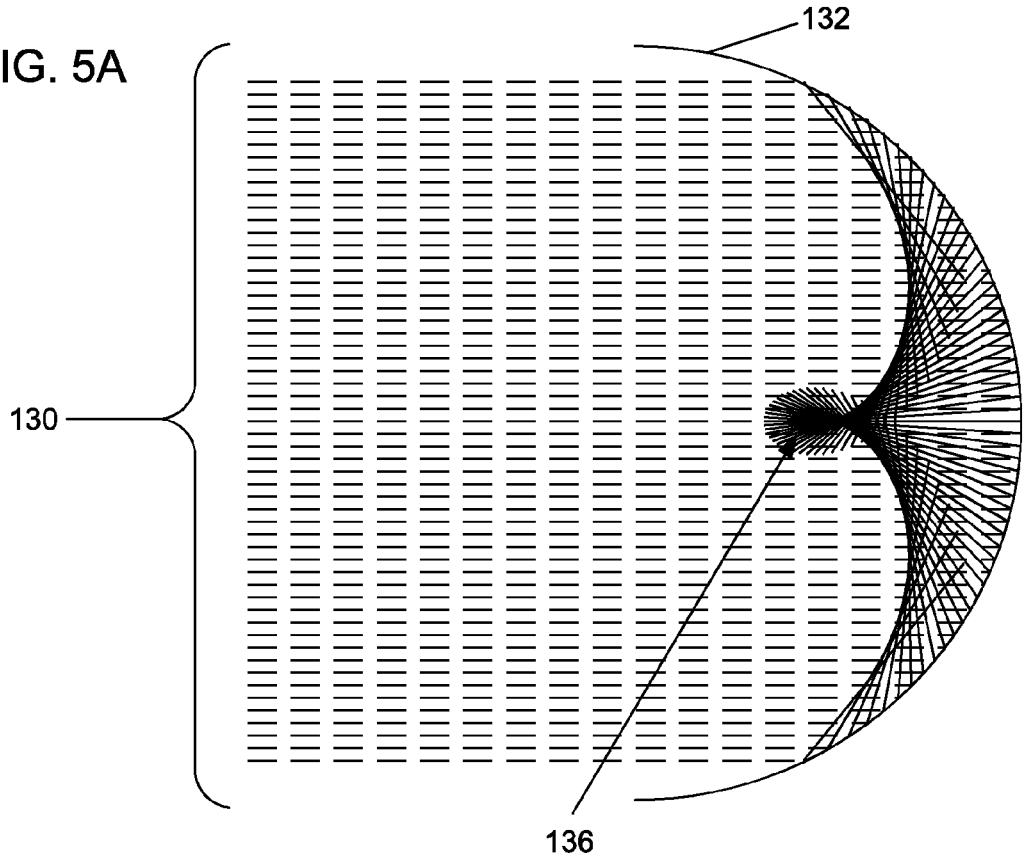
FIG. 5A is a conceptual illustration of a pattern of reflection of a plane wave incident on a curved reflector.
Figure 5B:
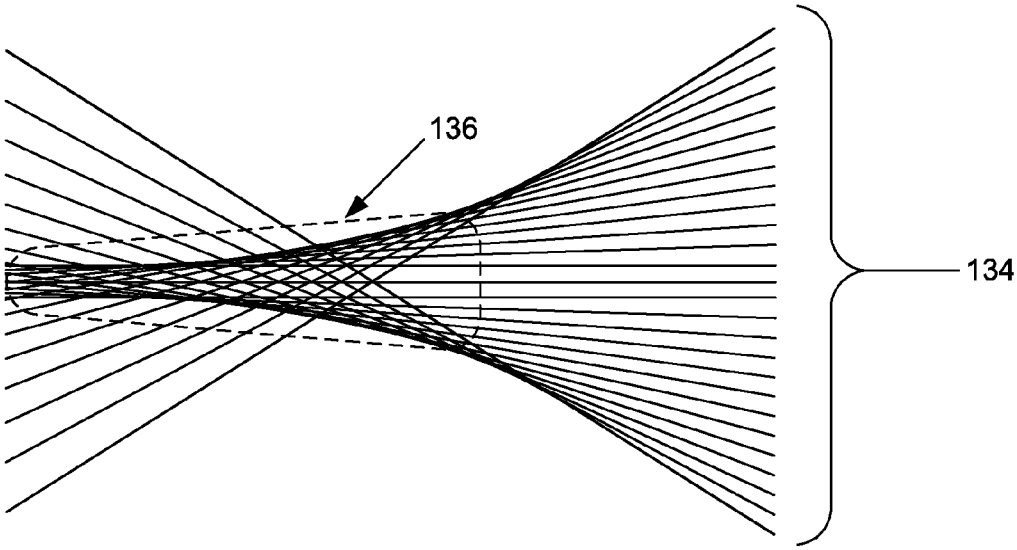
FIG. 5B is a conceptual illustration of the pattern of reflected rays from FIG. 5A along a focal line of a curved reflector.

FIG. 5A is a conceptual illustration of the pattern of reflection of a plane wave 130 incident on a cross section of a spherical reflector 132. Plane wave 130 is comprised of a plurality of individual rays of light, the paths of which are traced after reflecting off of spherical reflector 132. Incoming rays are shown using dashed lines, while reflected rays are shown using solid lines. The rays in plane wave 130 are not focused to a single point, but rather form a caustic. The rays are focused along a focal line, leading to an elongated reflected image. FIG. 5B is a close-up view of the pattern of reflected rays from FIG. 5A at the location indicated generally at 136. The convergence of the plurality of individual rays may form elongated reflected image, as also illustrated on dial-face 104 in FIGS. 4A and 4B. As illustrated in FIG. 5B, the plurality of rays 134 may appear to be an elongated pattern, as illustrated generally at location 136.

As illustrated in FIGS. 4A and 4B, reflected image 118 is not circular. Rather, reflected image 118 is elongated by optical aberration from curved reflector 102 and/or the impact of seasonal variations in the Earth's orbit. The elongated reflected image 118 may allow a user to more precisely determine the time by providing an elongated reflection that may generally appear as a clock hand.

Figure 6:
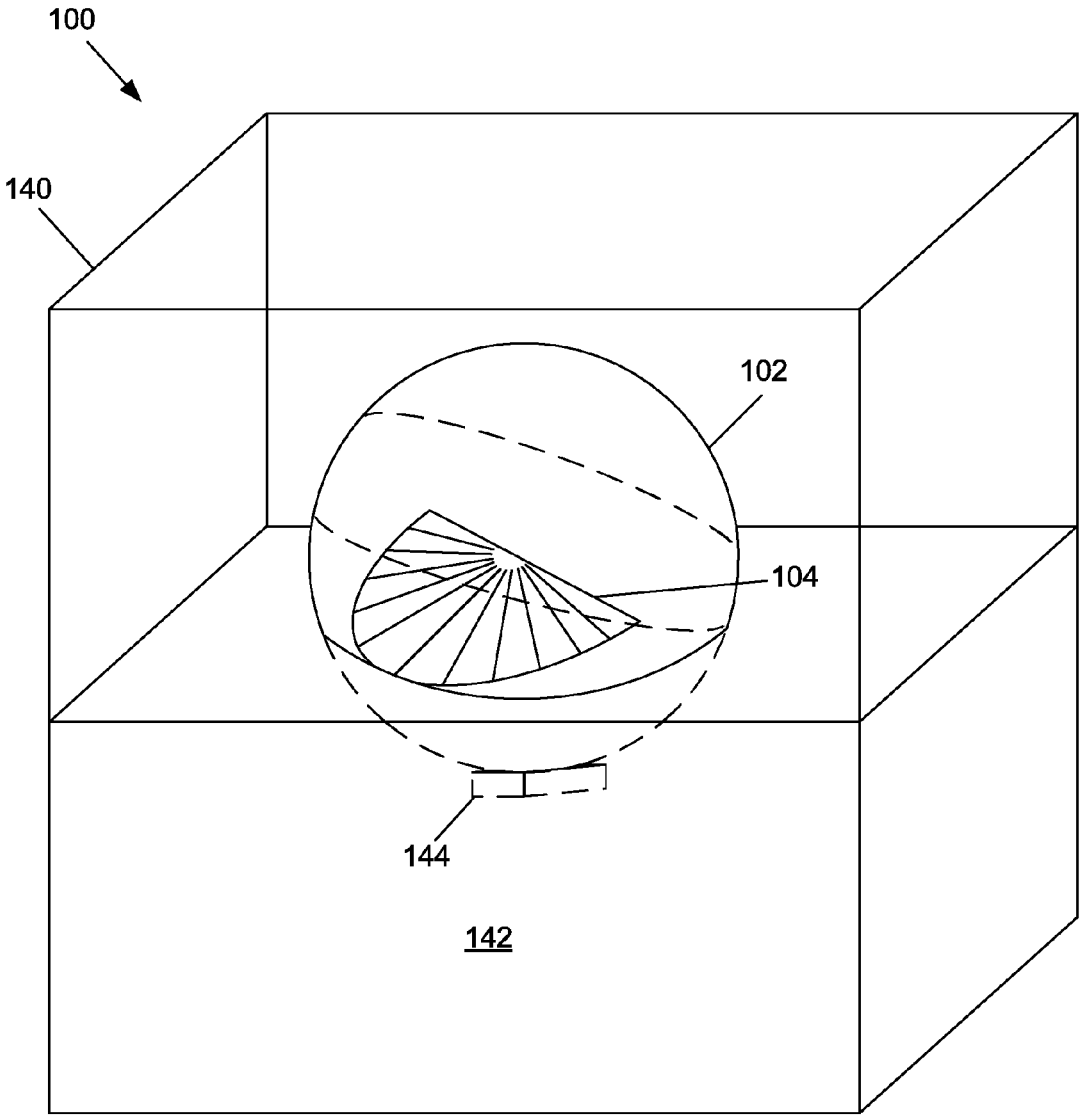
FIG. 6 is a perspective view of an embodiment of a sundial that is configured to be self-orienting.

FIG. 6 illustrates one embodiment of a self-orienting sundial 100. A sphere 102 containing a dial-face 104 may float in a reservoir 140 containing water 142, or other suitable liquid. A magnet 144 may be attached to sphere 102. The magnetic field of the Earth causes magnet 144 to point toward magnetic north. Magnet 144 may be aligned with respect to sphere 102 so as to compensate for any disparity between true north and magnetic north at a particular location on Earth.

Figures 7A, 7B, 7C:
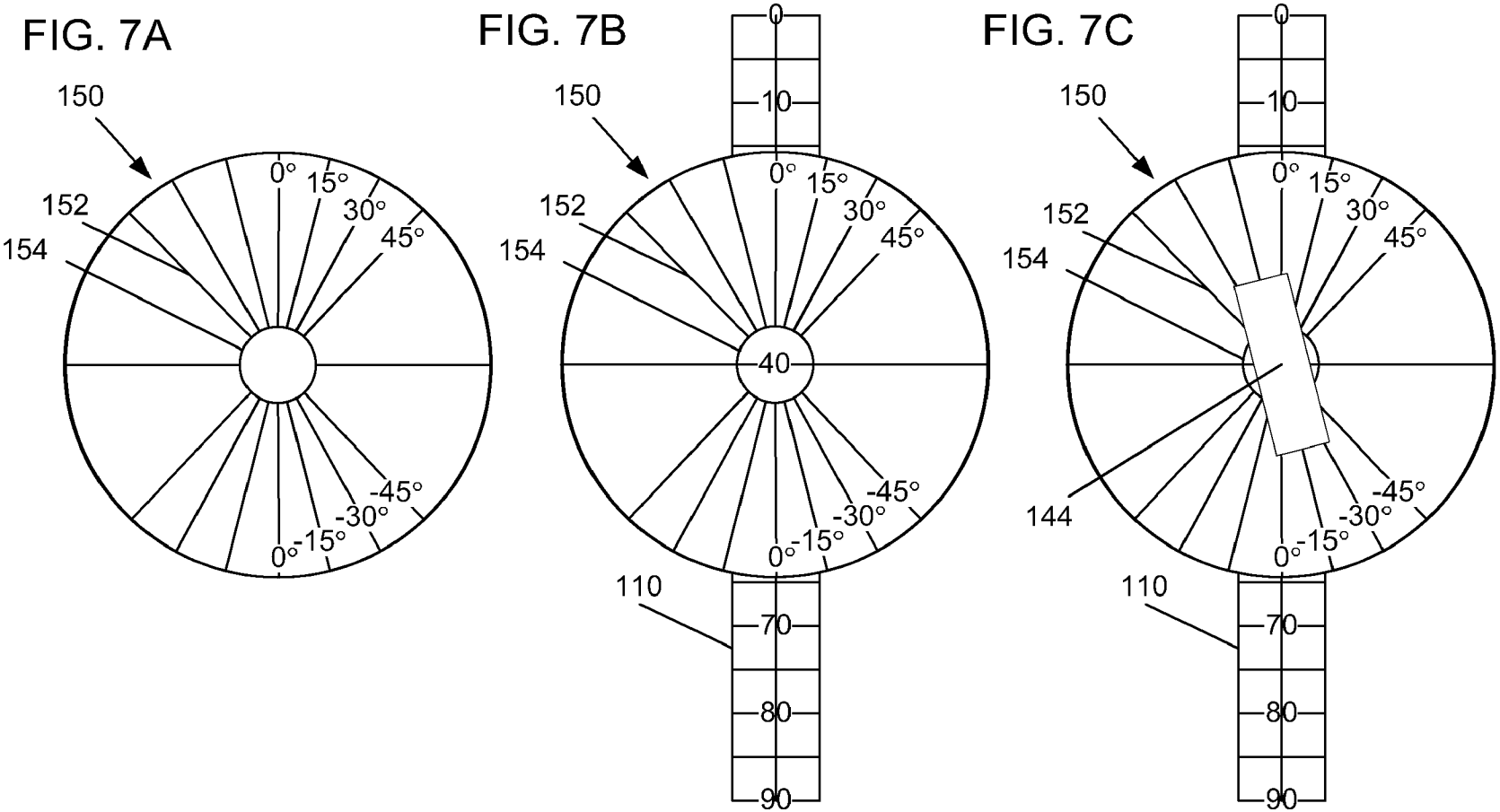
FIG. 7A is a plan view of a radial gauge.
FIG. 7B is a plan view of a radial gauge and a latitude marker.
FIG. 7C is a plan view of a radial gauge and a latitude marker together with a magnet.

FIGS. 7A, 7B, and 7C illustrate one method for aligning magnet 144 such that sphere 102 orients to north in operation. FIG. 7A illustrates a radial gauge 150. A plurality of radial markings 152 are disposed on radial gauge 150. Radial gauge 150 may include a hole 154 disposed in the center. In most locations on Earth, the true north and the magnetic north (to which a magnet will point) are not collocated. Accordingly, the plurality of radial markings 152 on radial gage 150 may be used to adjust an angle of the magnet with respect to the sphere by an amount equal to the magnetic declination at a user's location. Information about the magnetic declination at a particular point on the globe is available from a variety of sources, including the U.S. Geological Survey, National Geomagnetism Program, Reston, Va., also available at http://geomag.usgs.gov/charts/ (last accessed Feb. 10, 2009).

FIGS. 7B and 7C illustrate how radial gauge 150 may be used in conjunction with latitude marker 110 in order to adjust sundial 100 to operate at a particular latitude and a particular magnetic declination. The latitude marker 110 may be attached to sphere 102. Radial gauge 150 has been positioned with respect to latitude marker 110 such that the latitude marker corresponding to 40° is within hole 154. In FIG. 7C, magnet 144 is attached along the radial gauge line labeled 15°. Accordingly, sundial 100 has been configured for use at a latitude of 40°, and a magnetic declination of 15°. In an embodiment having a transparent curved reflector, radial gauge 150 and latitude marker 110 may be configured to be viewed through the transparent curved reflector (i.e. they may be mirrored in comparison to FIGS. 7A, 7B, and 7C).

In operation, the weight of magnet 144 positions the dial-face 104 to receive light reflected from the sphere 102 at the user's latitude. When floating in liquid 142 in reservoir 140, magnet 144 aligns with the magnetic field of the Earth. The adjustment of the angle of magnet 144 with respect to sphere 102 using radial gauge 150 causes dial-face 104 of sundial 100 to be oriented toward true north.

In an alternative embodiment, the radial gauge 150 may be embossed on, or otherwise attached to, a housing (not shown) configured to receive, hold, or connect to magnet 144. In such an embodiment, the housing containing magnet 144 may be placed over a particular latitude, rotated until radial markings 152 on the housing equal to the magnetic declination at the user's location align with the North/South axis on the sphere 102, then attached to the sphere.

The above description fully discloses preferred embodiments of a sundial. Without further elaboration, it is believed that one skilled in the art can use the preceding description to utilize the invention to its fullest extent. Therefore the examples and embodiments disclosed herein are to be construed as merely illustrative and not a limitation of the scope of the present invention in any way.

It will be obvious to those having skill in the art that many changes may be made to the details of the above-described embodiments without departing from the underlying principles of the invention. The scope of the present invention should, therefore, be determined only by the following claims.

The invention claimed is:

1. A sundial comprising:

a curved reflector comprising a sphere for reflecting an image of the sun; and a dial-face connected with the curved reflector, the dial-face comprising a plurality of time markers;

wherein the dial-face is movable to allow for adjustment of the sundial for operation at a plurality of different locations each having a different latitude; and wherein the sundial is configured to permit viewing of a reflected image of the sun on the dial-face, and to provide at least an approximate indication of the time based on the position of the reflected image of the sun with respect to the time markers on the dial-face.

2. The sundial of claim 1, wherein the dial-face is positioned within the sphere, and wherein the sphere is rotatable such that an angle of the dial-face with respect to a vertical plane may be adjusted to approximately a latitude of a location at which the sundial is used.

3. The sundial of claim 2, further comprising:

a plurality of latitude markings for orienting the sphere in accordance with the latitude of the location.

4. The sundial of claim 3, wherein the latitude markings are positioned on the sphere.

5. The sundial of claim 1, further comprising a stand configured to receive and support the curved reflector.

6. The sundial of claim 5, further comprising:

a plurality of latitude markings attached to the curved reflector, wherein the curved reflector is rotatable with respect to the stand, and wherein the curved reflector and the dial-face are rotatable together such that the angle of the dial-face with respect to a vertical plane may be adjusted to approximate the latitude of a location at which the sundial is used.

7. The sundial of claim 5, wherein the stand supports the curved reflector with no fixed points of connection between the stand and the curved reflector.

8. The sundial of claim 1, wherein the curved reflector is at least partially transparent.

9. The sundial of claim 1, wherein the dial-face comprises at least one of a copper mesh and a silica gel.

10. The sundial of claim 1, wherein the curved reflector comprises at least one of acrylic and glass.

11. The sundial of claim 1, wherein the plurality of time markers on the dial-face are evenly spaced.

12. The sundial of claim 1, wherein the sundial is configured such that the reflected image of the sun exhibits optical aberration during use.

13. The sundial of claim 1, wherein the dial-face is at least partially transparent such that the reflected image of the sun may be viewed on at least two opposing surfaces of the dial-face.

14. The sundial of claim 1, further comprising a directional indicator for aligning the dial-face with respect to a north-south direction.

15. The sundial of claim 1, further comprising:

a plurality of latitude markings for orienting the dial-face in accordance with the latitude of a particular location; and a reference line for aligning the latitude markings with a particular latitude of a location at which the sundial is used, wherein the directional indicator comprises a line, and wherein the reference line is perpendicular to the directional indicator.

16. The sundial of claim 1, further comprising:

a reservoir configured to receive a liquid, wherein the curved reflector is configured to be placed in the reservoir.

17. The sundial of claim 16, further comprising a magnet connected to the curved reflector, wherein the magnet is configured to redirect the curved reflector when the curved reflector is placed within the liquid in the reservoir.

18. The sundial of claim 17, further comprising:

a radial gauge configured to permit adjustment of an angle of the magnet with respect to the curved reflector in accordance with a magnetic declination of a location at which the sundial is used.

19. A sundial comprising:

an at least partially transparent sphere reflector for reflecting an image of the sun;

a dial-face positioned within the sphere, the dial-face comprising a plurality of substantially evenly-spaced time markers, wherein the dial-face is at least partially transparent such that the reflected image of the sun may be viewed on at least two opposing surfaces of the dial-face; and a stand comprising a base and a support piece, wherein the support piece is configured to directly contact the sphere, wherein the stand is configured to receive and support the sphere, wherein the sphere is rotatable with respect to the stand such that an angle of the dial-face with respect to a vertical plane may be adjusted to approximately the latitude of a location at which the sundial is used, wherein the sphere further comprises a plurality of latitude markings for orienting the sphere in accordance with the latitude of the location, and wherein the stand comprises a directional indicator for aligning the dial-face with respect to a north-south direction;

wherein the sundial is configured to permit viewing of a reflected image of the sun on the dial-face, and to provide at least an approximate indication of the time based on the position of the reflected image of the sun with respect to the time markers on the dial-face.

20. A method for determining at least an approximate indication of time using a sundial, the method comprising the steps of:

adjusting a dial-face of the sundial for operation at approximately the latitude of a location at which the sundial is used, wherein the dial-face comprises a first surface and a second surface, wherein the second surface opposes the first surface, and wherein the dial-face comprises a plurality of time markings;

orienting a curved reflector of the sundial to reflect an image of the sun onto the first surface, wherein the curved reflector comprises a sphere; and determining an approximate time by observing the reflected image of the sun and comparing the position of the reflected image to the time markers on the dial-face.

21. The method of claim 20, wherein the dial-face is positioned within the sphere, and wherein the step of adjusting a dial-face of the sundial comprises rotating the sphere such that an angle of the dial-face with respect to a vertical plane is adjusted to approximately the latitude of the location at which the sundial is used.

22. The method of claim 20, wherein the curved reflector is at least partially transparent.

23. The method of claim 20, wherein the sundial is positioned and configured such that the reflected image of the sun on the dial-face exhibits optical aberration during use.

24. The method of claim 20, further comprising:

aligning the dial-face with respect to a north-south direction.

25. The method of claim 24, wherein the step of aligning the dial- face comprises aligning a directional indicator positioned on the sundial with respect to a north-south direction.

26. The method of claim 20, wherein the step of determining an approximate time comprises observing the reflected image of the sun on the second surface of the dial-face.

27. The method of claim 20, wherein the step of adjusting a dial- face of the sundial comprises:

positioning a radial gauge with respect to a latitude marker such that the radial gauge is centered over the latitude marker corresponding to the latitude of the location, the latitude marker being disposed on the curved reflector;

connecting a magnet to the curved reflector at an angle indicated by the radial gauge in accordance with a magnetic declination of the location; and placing the sundial in a reservoir filled with a liquid such that the magnet can redirect an orientation of the dial-face.

28. A sundial comprising:

a curved reflector for reflecting an image of the sun;

a dial-face connected with the curved reflector, the dial-face comprising a plurality of time markers;

wherein the dial-face is movable to allow for adjustment of the sundial for operation at a plurality of different locations each having a different latitude; and wherein the sundial is configured to permit viewing of a reflected image of the sun on the dial-face, and to provide at least an approximate indication of the time based on the position of the reflected image of the sun with respect to the time markers on the dial-face;

a stand configured to receive and support the curved reflector; and a plurality of latitude markings attached to the curved reflector, wherein the curved reflector is rotatable with respect to the stand, and wherein the curved reflector and the dial-face are rotatable together such that the angle of the dial-face with respect to a vertical plane may be adjusted to approximate the latitude of a location at which the sundial is used.

29. The sundial of claim 28, wherein the curved reflector is at least partially spherical.

* * * * *